US006783354B2

(12) United States Patent
Retallick

(10) Patent No.: US 6,783,354 B2
(45) Date of Patent: Aug. 31, 2004

(54) LOW NOX COMBUSTOR FOR A GAS TURBINE

(75) Inventor: William B. Retallick, West Chester, PA (US)

(73) Assignee: Catacel Corporation, Leavittsburg, OH (US)

( * ) Notice: Subject to any disclaimer, the term of this patent is extended or adjusted under 35 U.S.C. 154(b) by 0 days.

(21) Appl. No.: 10/428,573

(22) Filed: May 2, 2003

(65) Prior Publication Data

US 2003/0215762 A1 Nov. 20, 2003

Related U.S. Application Data

(60) Provisional application No. 60/382,184, filed on May 20, 2002.

(51) Int. Cl.[7] ..... F23J 7/00

(52) U.S. Cl. ..... 431/4; 431/12; 431/76; 60/780

(58) Field of Search ..... 431/2, 4, 12, 76; 60/780, 781, 39.12

(56) References Cited

U.S. PATENT DOCUMENTS 5,441,401 A * 8/1995 Yamaguro et al. ..... 431/4
5,946,917 A * 9/1999 Hums et al. ..... 60/723
6,269,625 B1 * 8/2001 Dibble et al. ..... 60/777

FOREIGN PATENT DOCUMENTS

WO WO 01/95237 A2 * 12/2001

* cited by examiner

*Primary Examiner*—Jiping Lu
(74) *Attorney, Agent, or Firm*—William H. Eilberg

(57) ABSTRACT

A combustion system for a gas turbine includes a steam reformer and a combustor connected in series. A portion of the incoming fuel is diverted to the steam reformer, the balance passing directly to the combustor. The effluent from the steam reformer, which effluent includes a significant amount of hydrogen, is combined with the unreformed fuel entering the combustor. The result is a hot combustion gas which contains very little NOx.

15 Claims, 1 Drawing Sheet

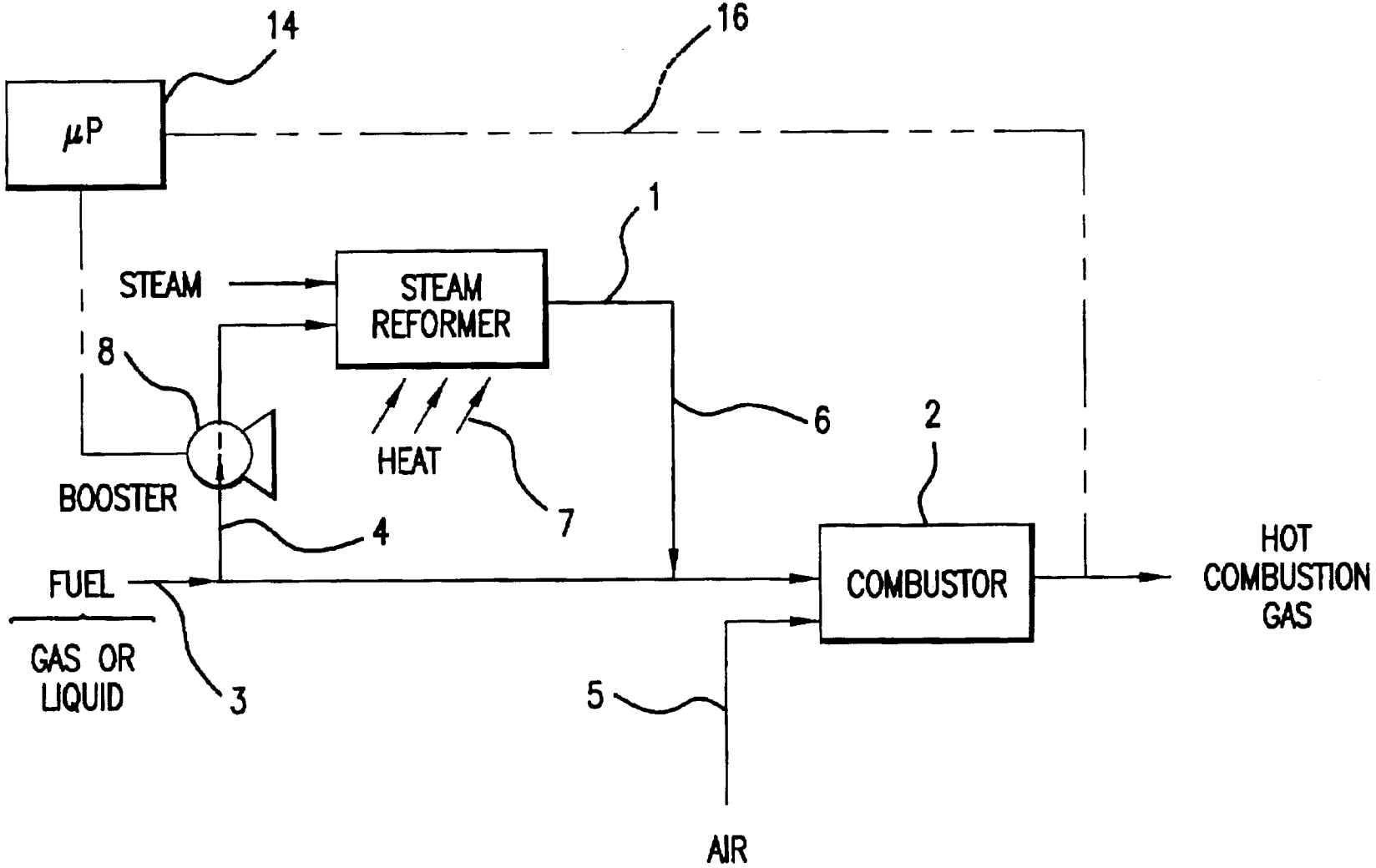
HOT COMBUSTION GAS
COMBUSTOR
2
6
16
1
AIR
5
7
STEAM REFORMER
HEAT
4
14
3
STEAM
8
BOOSTER
FUEL
GAS OR LIQUID
μP

LOW NOX COMBUSTOR FOR A GAS TURBINE

CROSS-REFERENCE TO PRIOR APPLICATION

This application corresponds to, and claims the priority of, U.S. Provisional Patent Application Ser. No. 60/382,184, filed May 20, 2002. The entire text of the above-cited provisional application is incorporated by reference herein.

BACKGROUND OF THE INVENTION

This invention relates to the field of combustion, and, in particular, to gas turbines that are driven by the exhaust from combustors that burn hydrocarbon fuels.

In combustors used to produce gases that drive turbines, there are two problems that have not yet been completely solved. First, at the customary high velocities of the gas streams in such combustors, the combustion flame can blow out. Secondly, the NOx in the exhaust stream can be as high as 25 ppm with gas fuel, and higher with distillate fuel.

It has been known, in the prior art, that as little as 2% of hydrogen, by volume, when mixed with the fuel, can stabilize the flame and prevent blowout.

It has also been known, in the prior art, that if the amount of hydrogen in the gas stream is increased to about 15%, by volume, the level of NOx can be reduced to about 2 ppm.

The present invention therefore provides a means of supplying hydrogen to the fuel used to power a combustor that drives a gas turbine. By supplying hydrogen in the necessary amount, the invention provides a combustion system in which the likelihood of blowout is minimized, and in which the level of NOx is low.

SUMMARY OF THE INVENTION

The present invention includes a combustion system which comprises a steam reformer, a combustor, and a source of fuel, which may be gas or liquid. A portion of the incoming fuel is diverted to the steam reformer through a booster pump, while the remainder of the fuel passes directly into the combustor. A source of steam is connected to the steam reformer. The steam reformer produces an effluent which is connected to the inlet of the combustor, so as to mix with the unreformed fuel. Because a significant portion of the effluent from the steam reformer is hydrogen, the incoming fuel-air mixture at the inlet end of the combustor will include hydrogen.

In the preferred embodiment, one chooses the amount of fuel diverted to the steam reformer according to a stoichiometric calculation, such that the volume of hydrogen in the fuel, at the inlet of the combustor, is up to about 15%. The result is that the combustor produces a relatively small amount of NOx.

The system may be automatically controlled by controlling a pump which supplies fuel to the steam reformer. When the concentration of NOx in the outlet stream of the combustor exceeds a predetermined level, the speed of the pump is increased, so as to increase the fuel flow to the reformer, thereby increasing the amount of hydrogen appearing at the inlet of the combustor. This control is preferably accomplished with a microprocessor that is connected to control the pump.

The invention also includes the method of operating a combustor for a gas turbine, wherein a portion of the incoming fuel is diverted to a steam reformer, the remainder passing directly to the combustor, and wherein the effluent from the steam reformer is combined with unreformed fuel entering the combustor.

The present invention therefore has the primary object of providing a combustion system for a gas turbine, wherein the combustion system produces very small amounts of NOx.

The invention has the further object of providing a combustion system for a gas turbine, wherein the combustion flame is not likely to blow out.

The invention has the further object of providing an efficient method of operating a combustor for use in a gas turbine system.

The invention has the further object of combining a steam reformer with a combustor to produce a combustion gas for driving a turbine, wherein the combustion gas has a low level of NOx.

The invention has the further object of providing a combustion system which automatically maintains a desired level of NOx in its outlet stream.

The reader skilled in the art will recognize other objects and advantages of the invention, from a reading of the following brief description of the drawing, the detailed description of the invention, and the appended claims.

BRIEF DESCRIPTION OF THE DRAWING

The FIGURE is a block diagram of the combustion system of the present invention.

DETAILED DESCRIPTION OF THE INVENTION

The FIGURE shows a block diagram of the combustion system of the present invention. The combustion system includes steam reformer 1 and combustor 2.

Steam reforming is an endothermic reaction wherein steam is reacted with hydrocarbon fuel to produce hydrogen. In the case in which the fuel is methane, the steam reforming reactions are:

$$CH_4+H_2O \rightarrow CO+3H_2$$

$$CO+H_2O \rightarrow CO_2+H_2$$

That is, steam reacts with methane to produce carbon monoxide and hydrogen. Some of the steam reacts with some of the carbon monoxide to produce carbon dioxide and hydrogen. Thus, the products of the steam reforming are carbon dioxide, carbon monoxide, and hydrogen.

As shown in the FIGURE, the fuel, which may be gaseous or liquid, is injected through conduit 3. A portion of the conduit branches off into conduit 4 which leads, through booster pump 8, to the steam reformer. Thus, the steam reformer and the combustor are effectively connected to a common source of fuel.

A major object of the invention is to provide a fuel, at the inlet of combustor 2, which includes up to about 15% hydrogen, by volume. This requirement translates into an amount of fuel that must be diverted to the steam reformer to produce the necessary hydrogen. The amount of fuel required can be calculated by standard stoichiometric considerations. It turns out that, if the fuel is methane, the desired amount of hydrogen will be produced if about 3–10% of the incoming fuel is diverted to the steam reformer. More preferably, 4–5% of the fuel may be so diverted.

The above-described percentages will change if a different fuel is used and/or if a different amount of hydrogen is desired.

The booster pump serves two purposes. First, it overcomes the pressure drop introduced by the reformer. If a pump were not used, the entire gas stream reaching the combustor would have to suffer the same pressure drop induced by the reformer. As shown in the FIGURE, the booster pump is placed in the flow path that passes through the reformer, but not in the main fuel line. The booster pump effectively insures that the required gas flow passes through the reformer.

Secondly, the booster pump can serve as a means of controlling the relative amount of fuel that is diverted to the steam reformer. In general, when the speed of the pump is increased, more fuel flows, per unit time, into the reformer, while the mass flow directly into the combustor is the same or lower. Thus, the ratio of fuel passing through the reformer, to the fuel passing directly to the combustor, is increased. Conversely, this ratio will decrease if the speed of the pump is reduced. The greater the proportion of fuel that flows into the reformer, the more hydrogen will be produced by the reformer, and the more hydrogen will be mixed with the fuel entering the combustor.

The proportion of fuel flowing into the reformer can be controlled by microprocessor 14. The microprocessor is connected to sense the concentration of NOx in the outlet stream of the combustor, as indicated by dashed line 16. The microprocessor is also connected to control the booster pump 8.

When the concentration of NOx in the outlet stream of the combustor exceeds a predetermined level, the microprocessor senses this increase, and is programmed to increase the speed of the booster pump 8. This increase in pump speed increases the amount of fuel flowing into the reformer, and results in more hydrogen appearing at the outlet of the reformer. Thus, more hydrogen becomes mixed with the fuel entering the combustor, causing the combustor to produce less NOx. Conversely, when the level of NOx falls, the microprocessor senses this decrease, and decreases the speed of pump 8, so that the amount of hydrogen mixed with the fuel is decreased.

By causing the pump to speed up or to slow down, the microprocessor effectively controls the proportion of fuel that is diverted into the reformer.

It is possible to omit the microprocessor, within the scope of the invention, if the automatic control feature is not desired.

The microprocessor may be any electronic or electromechanical control device that can receive signals and generate control commands as described above.

Because the steam reforming reaction is endothermic, heat must be supplied to reformer 1 to drive the reaction. The FIGURE shows heat being supplied, as indicated by arrows 7. This heat may come from various possible sources. In the most preferred embodiment, some of the incoming fuel can be diverted into a separate combustor (not shown) which would provide the required heat. But the invention is not limited to the case in which the heat for the steam reformer is derived from the same source of fuel which supplies the combustor. It is possible to provide heat that is derived from an entirely independent source.

The fuel which has not been diverted to the steam reformer (and which has not been diverted to a separate combustor, if present, for heating the steam reformer) enters combustor 2. The combustor is also supplied with air, through conduit 5. The products of the steam reforming reactions, which include hydrogen, pass through conduit 6 and into the combustor 2.

The entire effluent from the steam reformer, namely hydrogen, carbon monoxide, carbon dioxide, unreacted steam, and unreacted fuel (such as methane), is combined with the unreformed fuel. In the most preferred embodiment, wherein methane is the fuel, the unreformed fuel comprises 95–96% of the fuel which enters the system through conduit 3. This mixture will contain up to about 15% hydrogen.

If the fuel is a hydrocarbon other than methane, the amount of fuel needed to yield the desired percentage of hydrogen will be different. But it is always possible to adjust the amount of fuel so as to produce the necessary amount of hydrogen.

Thus, the combination of a steam reformer and a combustor achieves the desired low NOx level. The steam reformer provides the necessary level of hydrogen, in the fuel supplied to the combustor, to reduce the amount of NOx at the output of the combustor.

The invention can be modified in various ways. The invention is not limited to any particular fuel. Different fuels may be used, each requiring its own calculation of the stoichiometric requirement for producing the desired amount of hydrogen. The source of heat supplied to the steam reformer can also be changed. This heat source may be produced using some of the incoming fuel, or it can be produced independently. The microprocessor may be replaced by an equivalent control device. These and other similar modifications, which will be apparent to those skilled in the art, should be considered within the spirit and scope of the following claims.

What is claimed is:

1. A combustion system comprising:

a) a steam reformer, b) a combustor, and c) a source of fuel, and means for distributing a portion of the fuel to the combustor and a portion of the fuel to the steam reformer, wherein the distributing means is set such that a portion of the fuel passes into the steam reformer, the remainder passing into the combustor, and wherein the steam reformer has an output effluent that is combined with unreformed fuel that passes into the combustor, further comprising means for controlling a proportion of fuel that flows into the reformer, wherein the controlling means includes means for sensing a component of an outlet stream of the combustor, and for adjusting the proportion of fuel flowing into the reformer in response to said sensed component.

2. The combustion system of claim 1, wherein the fuel is methane, and wherein the portion of the fuel that passes into the steam reformer is about 3–10%.

3. The combustion system of claim 2, wherein the portion of the fuel that passes into the steam reformer is about 4–5%.

4. The combustion system of claim 1, wherein the portion of the fuel that passes into the steam reformer is chosen such that a gas stream entering the combustor contains up to about 15% hydrogen.

5. A combustion system comprising a steam reformer and a combustor connected in series, wherein the steam reformer and the combustor are connected to a common source of fuel, wherein a portion of the fuel passes into the steam reformer and the balance passes directly to the combustor, wherein the steam reformer has an effluent that passes into an inlet end of the combustor, further comprising means for monitoring a concentration of NOx in an outlet stream of the combustor, and for adjusting a proportion of fuel flowing into the steam reformer in response to said concentration.

6. The combustion system of claim 5, further comprising a pump for conveying fuel into the steam reformer, and wherein the means for monitoring and adjusting comprises a microprocessor which is connected to control the pump.

7. The combustion system of claim 5, wherein the fuel is methane, and wherein the portion of the fuel that passes into the steam reformer is about 3–10%.

8. The combustion system of claim 7, wherein the portion of the fuel that passes into the steam reformer is about 4–5%.

9. The combustion system of claim 5, wherein the portion of the fuel that passes into the steam reformer is chosen such that a gas stream entering the combustor includes up to about 15% hydrogen.

10. A method of operating a combustor for a gas turbine, wherein the combustor receives fuel from a source, the method comprising:

a) passing a portion of the fuel from the source that supplies the combustor into a steam reformer, and b) combining effluent from the steam reformer with unreformed fuel entering the combustor, further comprising monitoring a concentration of NOx in an outlet stream of the combustor, and controlling a proportion of fuel flowing into the steam reformer in response to said concentration.

11. The method of claim 10, wherein the controlling step comprises controlling a pump which conveys fuel into the steam reformer.

12. The method of claim 10, further comprising selecting the fuel to be methane, and selecting the portion of the fuel that passes into the steam reformer to be about 3–10%.

13. The method of claim 12, wherein the portion of the fuel that passes into the steam reformer is selected to be about 4–5%.

14. The method of claim 10, further comprising selecting the portion of the fuel that passes into the steam reformer such that a gas stream entering the combustor includes up to about 15% hydrogen.

15. The method of claim 10, further comprising the step of controlling a fraction of the fuel that passes into the steam reformer, and a fraction of the fuel that passes directly into the combustor.

* * * * *